United States Patent [19]

Heddon

[11] 4,169,602

[45] Oct. 2, 1979

[54] PREFABRICATED BOWLING LANE

[76] Inventor: Will Heddon, P.O. Box 1127, Lake Wales, Fla. 33853

[21] Appl. No.: 905,216

[22] Filed: May 12, 1978

[51] Int. Cl.[2] ..... A63D 1/04

[52] U.S. Cl. ..... 273/51; 144/309 R

[58] Field of Search ..... 273/51

[56] References Cited

U.S. PATENT DOCUMENTS

| | | | |
|---|---|---|---|
| 2,039,580 | 4/1936 | Boarders | 273/51 |
| 2,969,983 | 1/1961 | De Vore | 273/51 |
| 3,014,722 | 12/1961 | Green | 273/51 |
| 3,279,795 | 10/1966 | Larson | 273/51 |

*Primary Examiner*—Anton O. Oechsle

*Attorney, Agent, or Firm*—Duckworth, Hobby, Allen & Pettis

[57] ABSTRACT

A prefabricated bowling lane is fabricated in modules at a manufacturing facility. Each lane module includes a base, a panel formed from a plurality of laminated hardwood strips joined side to side and securing means for attaching the lane module to the existing lane support structure of a bowling alley. The panel formed from laminated hardwood strips is bonded to the upper surface of the base. The width of each panel is greater than the width of its base in order to form a female notch along each side of the lane section for securing one side of each adjacent gutter to the lane section. The approach modules of the present invention are constructed in a manner very similar to the lane modules except that the sides of each approach module include both first and second female notches for receiving specially configured approach fill means which span the approach area between adjacent bowling lanes. The approach fill means includes premanufactured wooden subassemblies which are readily installed.

23 Claims, 18 Drawing Figures

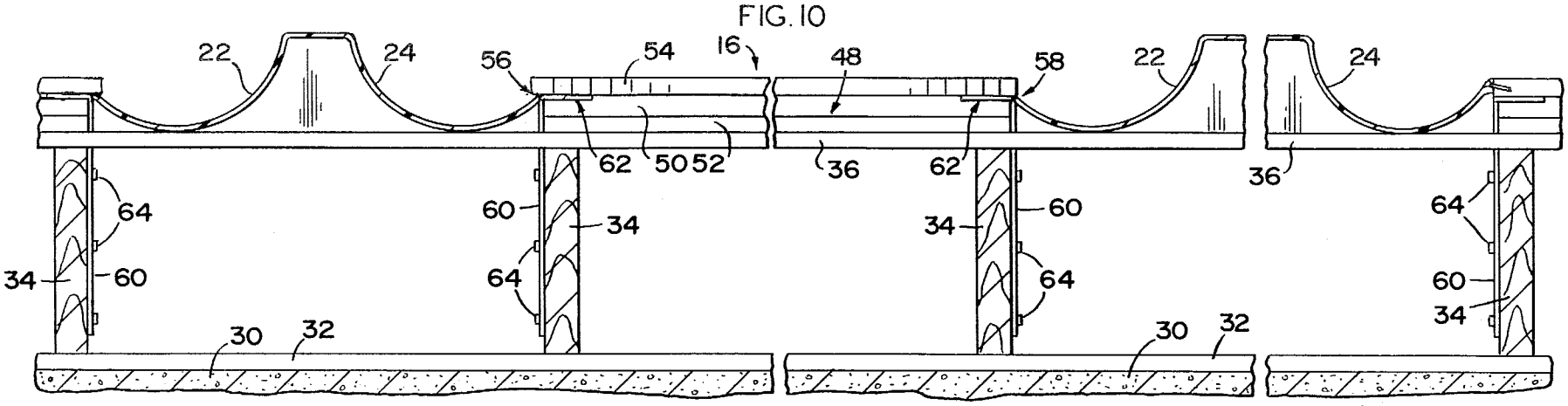
FIG. 10
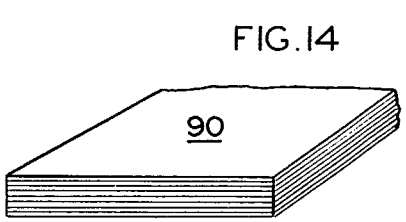
FIG. 14
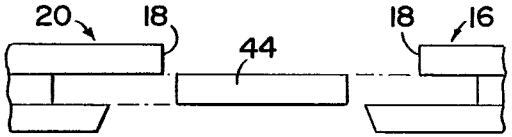
FIG. 12
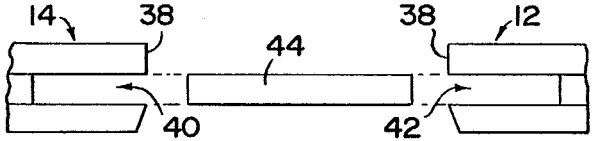
FIG. 11
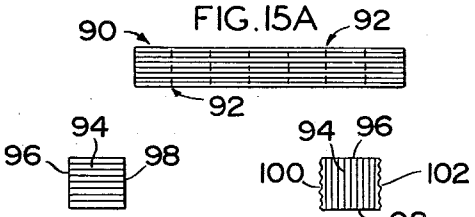
FIG. 15A
FIG. 15B
FIG. 15C
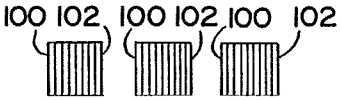
FIG. 15D
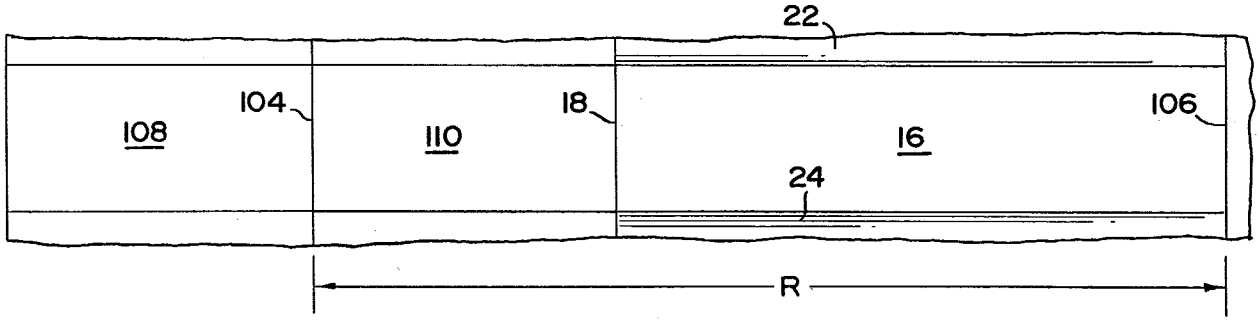
FIG. 13

PREFABRICATED BOWLING LANE

BACKGROUND OF THE INVENTION

1. Field of the Invention

This invention relates to bowling lane construction, and more particularly to the manufacturing and assembly of prefabricated wooden bowling lane modules.

2. Description of the Prior Art

After about twenty years of use and periodic refinishing of the surface of bowling lanes, a sufficient amount of the hardwood surface of each lane will have been removed that the entire lane must be replaced.

Replacement of a complete bowling lane is a time consuming and costly procedure. The existing lane structure must be removed and a replacement lane must be assembled by hand at the installation site. This replacement operation involves reconstructing the laminated hardwood lane deck by nailing tongue and groove hardwood strips together at eight inch intervals. Literally thousands of nails are used in reconstructing a single lane of a bowling alley. Additionally, a large number of four inch lag bolts must be installed by hand at intervals along the outer edge of each hardwood deck to rigidly secure the deck to the underlying lane support structure. The gutters are secured to the sides of the laminated hardwood deck by a plurality of nails.

Since the entire installation assembly must be completed at the job site and since very few companies specialize in bowling lane replacement work, substantial expenditures are incurred in transporting a twenty man installation crew from the company's home base to the construction site. Additional expenses are incurred as a result of the food and lodging requirements of the work crew. During the lane replacement operation, the bowling alley must be closed and its income generating capacity terminates.

U.S. Pat. No. 2,788,973 (Grawey) discloses one early attempt to manufacture replacement bowling lane sections at a centrally located manufacturing plant. Grawey teaches the use of prefabricated laminated sections disposed in end to end engagement which include tongue and groove joints between adjacent sections for securing the end of one section to the end of an adjacent section. The Grawey reference teaches the use of side members which require a plurality of lag bolts to secure the side member to the laminated panels and to secure the side member to the bowling alley support structure. The hole drilling and lag bolt installation requires a great deal of manual labor.

The Grawey reference does not disclose how the lamination of the hardwood strips in each lane section is to be accomplished. The laminating process which Grawey indicates is to be used in fabricating his laminated hardwood deck has to this day not been perfected by others. As a result all replacement bowling lanes currently being installed include hardwood decks assembled by hand from hardwood strips which are secured to one another by a plurality of nails.

U.S. Pat. No. 2,969,983 (De Vore) discloses a method of fabricating a laminated hardwood bowling lane at a replacement site. In De Vore's system a first base panel is secured by a plurality of screws to the existing lane support structure, while a second base member is secured by a plurality of screws to the first base member. As a result of the necessity for two sets of screws to attach the two base sections to the lane support structure, the laminated hardwood deck must be assembled and bonded to the base members at the installation site. Prefabrication is thus rendered impossible. The De Vore reference teaches that the laminated deck formed from a plurality of hardwood strips is secured by glue only to the uppermost base member and to nothing else.

U.S. Pat. No. 3,014,722 (Green) discloses a prefabricated bowling lane structure for outdoor use and includes horizontally disposed laminated sheets. The system utilizes a tongue and groove arrangement to securely couple the ends of adjacent lane sections. A turnbuckle is also provided to maintain two adjacent lane sections in abutting contact.

U.S. Pat. No. 1,511,696 (Wendt) discloses a hardwood bowling surface formed by placing a plurality of hardwood strips adjacent one another and securing them in place by a plurality of bolts which extend through holes drilled through the sides of the hardwood strips. Properly drilling and aligning the holes in the various hardwood strips is a difficult and time consuming procedure.

U.S. Pat. No. 2,039,580 (Boarders) discloses a replacement for the approach section of a bowling lane. This replacement section is formed from a plurality of hardwood strips having a tongue and groove construction and is held together by a plurality of nails extending from each strip into an adjacent strip.

U.S. Pat. No. 3,211,454 (Bailey) discloses a vertically adjustable bowling lane replacement section. This section is formed from a plurality of hardwood strips having a tongue and groove construction which can be repositioned by jack screws. This replacement section is irregular in shape and difficult to install and adjust.

Other prior art of interest is disclosed in the following U.S. Pat. Nos. 490,916 (Montgomery); 2,301,778 (Gremp); 2,686,054 (Coroniti); 3,312,469 (Clayton); 3,223,415 (Stengel); 757,922 (Herbst); 4,036,496 (Robinson); 3,670,049 (Stein); 3,476,387 (Cepluch); 631,090 (Mussey); 563,362 (Dokkenwadel); 471,244 (Montgomery); 2,493,620 (Cusano); 1,961,765 (James); 1,724,841 (Karr); 359,542 (Reisky & Wolff); 2,301,777 (Gremp); 2,209,082 (Debay); 1,581,423 (Blanchard); 2,483,976 (Hughes); 543,141 (Rieper); 1,529,295 (Blanchard); 1,795,624 (Treiber); 2,479,477 (Cusano); 1,967,858 (Borders);

SUMMARY OF THE INVENTION

It is therefore a primary object of the present invention to provide a complete bowling lane structure which can be prefabricated in modular replacement sections at a manufacturing facility and transported to the installation site to reduce by eighty percent the time required to install a complete replacement lane and to substantially reduce the cost and down time associated with the replacement of a bowling lane.

Another object of the present invention is to provide prefabricated bowling lane modules which are manufactured without nails or screws and which can be secured to existing bowling alley support structure by a very limited number of nails.

Yet another object of the present invention is to provide prefabricated bowling lane modules having laminated hardwood panels formed from hardwood strips bonded side to side.

Still another object of the present invention is to provide prefabricated bowling lane modules which secure one side of each adjacent gutter in place without nails, screws or other securing means.

A still further object of the present invention is to provide prefabricated bowling lane modules which permit the placement of the ball drop zone and a part of the approach section of a bowling lane.

Briefly stated, and in accord with one embodiment of the invention, a plurality of prefabricated lane modules form a complete bowling lane when installed end to end. Each lane module includes a base and a panel formed from a plurality of laminated hardwood strips joined side to side. The panel is bonded to the upper surface of the base and the width of the panel exceeds the width of the base to form a female notch along each side of the lane module. This notch is provided to secure one side of each adjacent gutter to the lane module. Securing means attaches the lane module to the existing lane support structure.

The invention also contemplates a prefabricated approach section which includes first and second approach modules and approach fill means positionable between the first and second approach modules. The approach fill means is supported by and attached to the existing leveling strips to form a smooth, hard surface area between the first and second approach modules. Each approach module is aligned with a particular bowling lane and includes a base having a second female notch along the lower surface of each side and a panel formed from a plurality of laminated hardwood strips joined side to side. The panel is bonded to the upper surface of the base and its width exceeds the width of the base to form a first female notch along each side of the approach module.

DESCRIPTION OF THE DRAWINGS

The invention is pointed out with particularity in the appended claims. However, other objects and advantages, together with the operation of the invention may be better understood by reference to the following detailed description taken in connection with the following illustrations wherein;

FIG. 10 is an enlarged, fragmentary end elevational view, as viewed along line 10—10 of FIG. 1, of a lane module of the present invention showing the manner in which one side of adjacent gutters are secured to the female notch in each side of the lane section. The right hand side of FIG. 10 illustrates the manner in which a gutter is secured to a lane module of the present invention when only the ball drop zone of the lane is replaced.

FIG. 11 is an enlarged, exploded view of a typical end to end connection between lane modules.

FIG. 12 is an enlarged, exploded view of the end to end connection of an approach module to a lane module at the foul line.

FIG. 13 is a fragmentary, top plan view of the foul line area of an existing bowling lane illustrating how a portion of the approach section and the ball drop zone may be repaired by cutting out one section and replacing it with prefabricated bowling lane modules of the present invention.

FIG. 14 illustrates the horizontally oriented grain structure of commercially available hardwood which is used in fabricating the hardwood strips for the laminated hardwood panel of each prefabricated bowling lane module.

FIG. 15A-D illustrates the steps involved in converting the hardwood plank of FIG. 14 into smooth sided hardwood strips suitable for lamination.

DESCRIPTION OF THE PREFERRED EMBODIMENT

In order to better illustrate the advantages of the invention and its contributions to the art, a preferred hardware embodiment of the invention will now be described in some detail. Thereafter, the method of manufacturing the laminated hardwood surface of the prefabricated bowling lane modules of the present invention will be described in detail.

Figure 1:
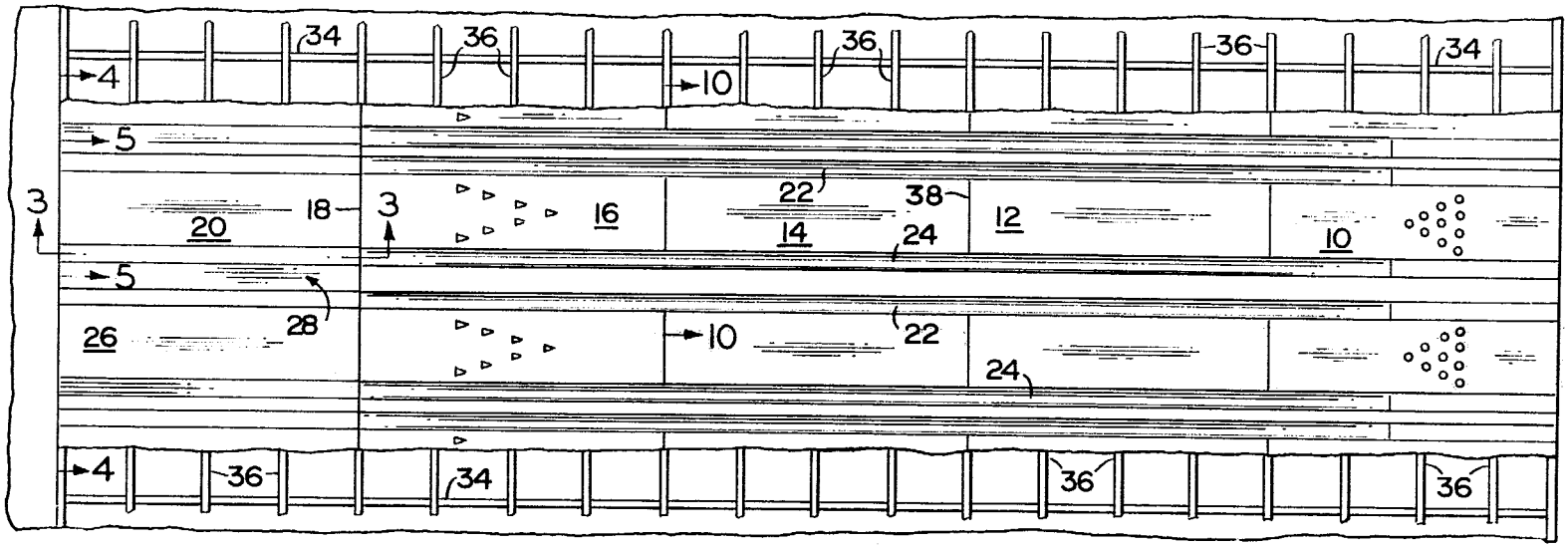
FIG. 1 is a fragmentary top view of the existing lane support structure of a bowling alley and two complete bowling lanes assembled from the prefabricated bowling lane modules of the present invention.
Figure 2:
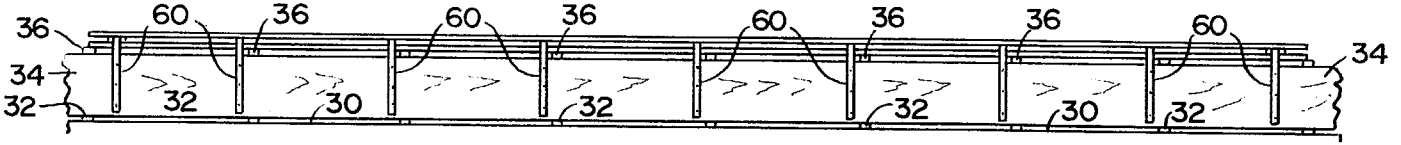
FIG. 2 is a side elevational view of one of the lane modules of the present invention together with the existing lane support structure.

FIG. 1 illustrates that five sixteen foot modules are required to span the entire eighty foot length of a bowling lane. Pin deck module 10 supports the bowling pins at one end and includes ten inlaid pin marks at one end. Three other lane modules 12, 14 and 16 span the distance between the pin deck and the foul line 18. Lane module 16 includes seven inlaid ball guides. Foul line 18 separates lane module 16 from approach module 20. Gutters 22 and 24 run adjacent to each lane from foul line 18 to the end of lane module 10. At a point toward the end of lane module 10 the curved gutter terminates and becomes a flat bottomed gutter. The remaining approach area between approach modules 20 and 26 forms a smooth wooden surface and is referred to as approach fill means 28.

Figure 3:
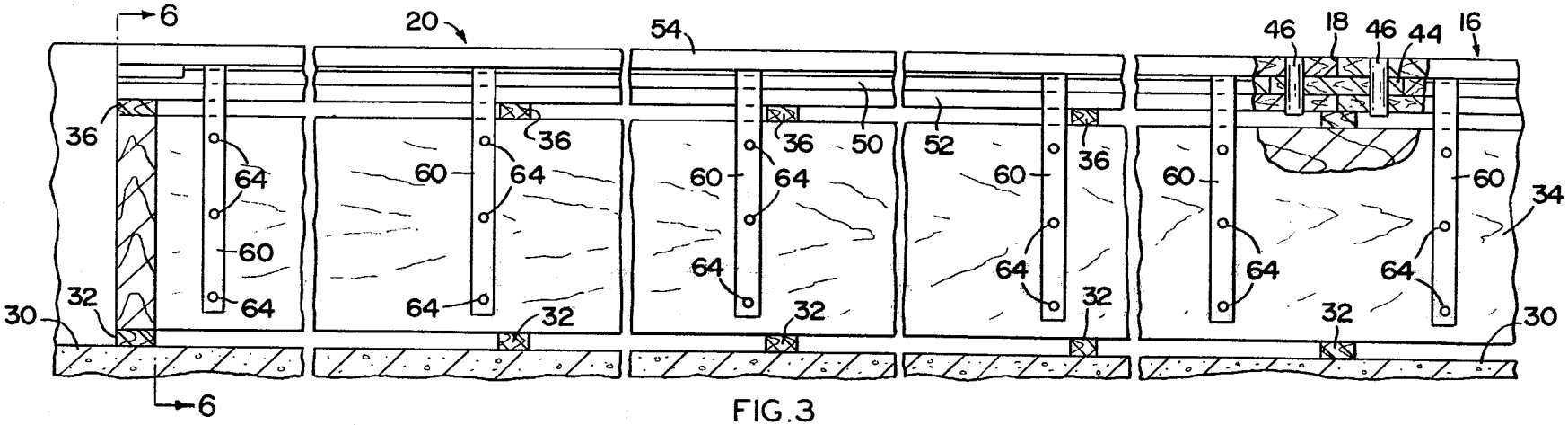
FIG. 3 is an enlarged, fragmentary side elevational view, partly broken away and partly in section, of an approach module of the present invention, as viewed along line 3—3 of FIG. 1.

Referring now to FIGS. 1 and 3, the entire bowling structure is supported by the concrete floor 30 of the bowling alley. A plurality of wooden anchor strips 32 are positioned above the upper surface of concrete floor 30 and run in a direction perpendicular to the orientation of the bowling lanes. A plurality of $2\times10$ stringers designated as lane support structure 34 run parallel to the direction of the bowling lane and are supported by anchor strips 32. A plurality of leveling strips 36 are positioned above lane support structure 34 and immediately below the prefabricated lane modules in a direction perpendicular to the orientation of the bowling lanes. Anchor strips 32, lane support structure 34 and leveling strips 36 would have been installed when the bowling alley and its initial set of lanes were first constructed. The present invention in no way modifies these existing structures. Each of the prefabricated bowling lane modules is directly supported by leveling strips 36.

Referring now to FIGS. 1 and 11, the means for rigidly coupling the end surfaces 38 of adjacent lane modules is shown. A horizontally oriented groove 40 is disposed in the end of lane module 14, while another horizontally oriented groove 42 is disposed in the adjacent end of lane module 12. A splice plank 44 is inserted within grooves 40 and 42 in order to vertically align and attach the end of lane module 14 with the end of lane module 12.

Referring now to FIGS. 3 and 12, a somewhat different coupling means is illustrated for rigidly securing and aligning lane module 16 with approach module 20. Since it is probable that bowling balls will be dropped directly on foul line 18, this particular connection must be stressed for ball drop impacts. Thus the somewhat different groove and splice plank configuration shown in FIGS. 3 and 12 is utilized beneath foul line 18 to provide this additional required strength. Additional splice plank securing means is typically provided in the form of a pair of vertically oriented dowl rods 46 which are driven into holes extending through the ends of adjacent modules and the splice plank. Some form of adhesive will normally be provided to form an adhesive bond between the splice plank and the surfaces adjoining grooves 40 and 42.

Referring to FIG. 10, the structure of the lane modules will now be described. Lane module 16 is shown disposed between gutters 22 and 24. The stringers or lane support structure 34 supports leveling strip 36 which runs perpendicular to the orientation of the bowling lane. The base 48 of lane module 16 is in the preferred embodiment formed from two one inch thick particle boards 50 and 52 which have been bonded together. Base 48 could equally well be formed from plywood or any other suitable structure. The upper deck of panel 54 of lane module 16 is formed from a plurality of laminated hardwood strips, the vertical side surfaces of each having been adhesively bonded or laminated together. Each hardwood strip is of a random length and has a vertically oriented grain structure to provide the maximum strength and resistance to wear resulting from use of the lane and resurfacing procedures. Maple strips are typically used in the fabrication of this panel. The lower surface of panel 54 is bonded to the upper surface of base 48. The width of panel 54 exceeds the width of base 48 in order to form female notches 56 and 58 along the sides of lane module 16. The female notches serve the purpose of securing one side of each adjacent gutter to each lane module and eliminate the need for otherwise securing by nails, screws or glue the adjacent gutters to the lane modules.

Securing means in the form of metal hold down straps 60 are inserted into and connected to slots 62 formed in base 48. Hold down straps 60 are designed to extend downwardly from the sides of each lane module at a point between leveling strips 36 to a location adjacent lane support structure 34. A plurality of holes is provided in hold down strap 60 so that nails 64 may be driven through the straps into the lane support structure 34 in order to securely couple each lane module to the lane support structure along the complete length of each module. Both the lane modules and approach modules are secured in this manner.

Figure 4:
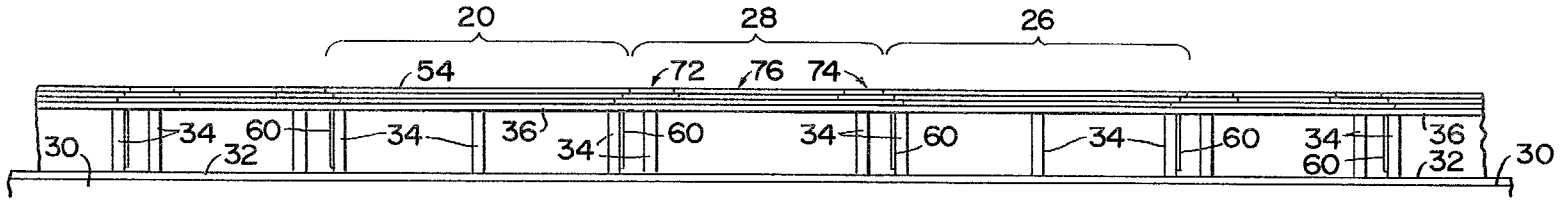
FIG. 4 is an end elevational view of several approach modules, the approach fill means and the existing bowling alley lane support structure.

Referring now to FIGS. 1 and 4, approach fill means 28 is shown disposed between approach modules 20 and 26. Each of these three units extends between the approach end of the bowling lane and the line formed by foul line 18.

Figure 5:
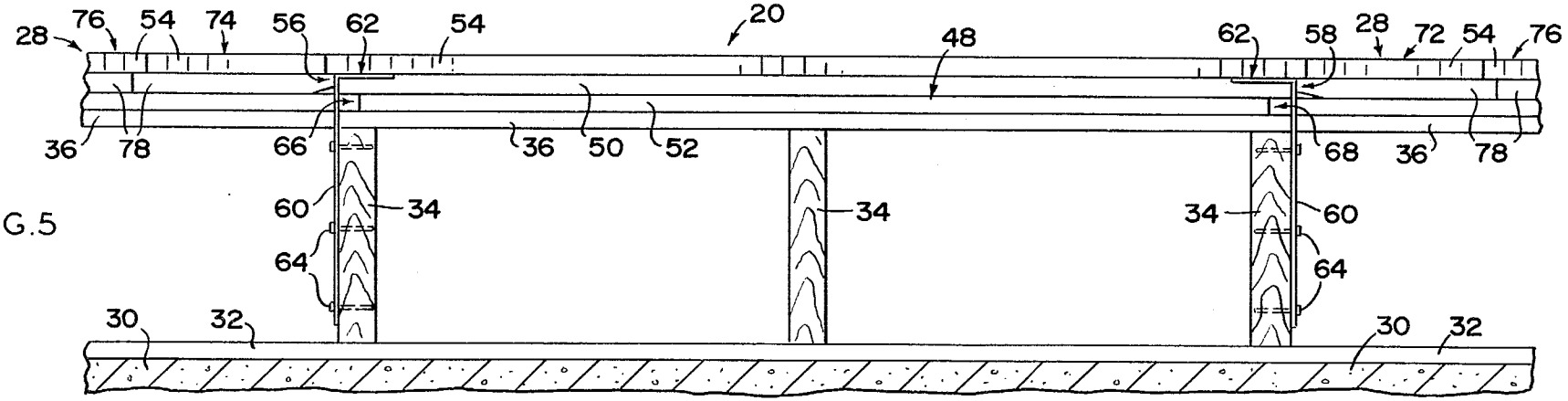
FIG. 5 is an enlarged fragmentary end elevational view of one approach module of the present invention, as viewed along 5—5 of FIG. 1.

Referring now to FIGS. 4 and 5, approach module 20 is illustrated as including many of the same elements which were described in connection with lane module 16. The primary difference between an approach module and a lane module is that an approach module includes second female notches 66 and 68 which extend along the lower surface of each side of the base.

Figure 6:
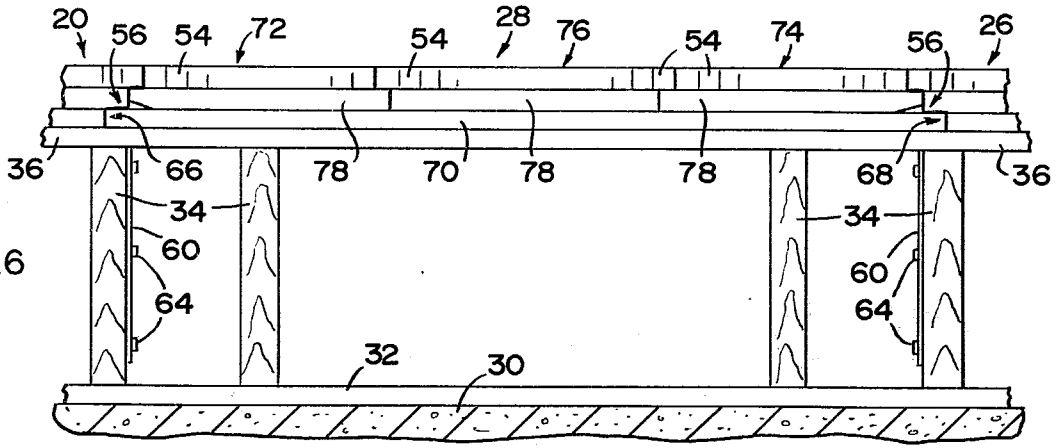
FIG. 6 is an enlarged, fragmentary end elevational view of the approach fill means between adjacent approach modules, as viewed along line 6—6 of FIG. 3.

Referring now to FIGS. 4 and 6, approach fill means 28 will be described. Approach fill means 28 is sixteen feet in length as are all the other approach and lane modules. The approach fill means is designed to bridge the gap between adjacent approach modules. This gap is created by the spacing required for the insertion of the gutters and ball returns between adjacent bowling lanes. The approach fill means is designed to be readily insertable between adjacent approach modules after the approach modules have been secured to lane support structure 34. A plurality of 2×4 shim strips 70 form a part of the approach fill means and are disposed at predetermined intervals along the length of the approach fill means. These shim strips are also designated as approach fill support means. Shim strips 70 are designed to be inserted into and secured by the second female notches 66 and 68 of adjacent approach modules.

Figure 7:
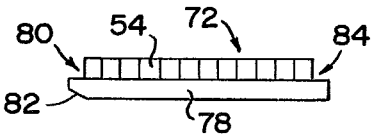
FIGS. 7-9 are end elevational views of the first and second wing modules and the key way module included in the approach fill means illustrated in FIG. 6.
Figure 8:
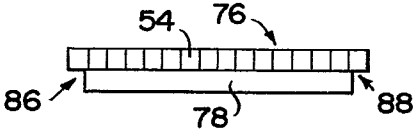
Figure 9:
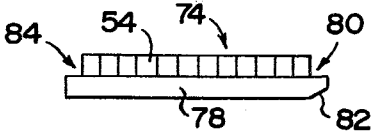

Referring now to FIGS. 7, 8 and 9, the remaining elements of approach fill means 28 include first wing module 72, second wing module 74 and key way module 76. All three of these modules include a hardwood deck or panel 54 of the type described earlier. Each of these modules also includes a base which is bonded to panel 54 but which is of a shallower depth than base 48 of the approach and lane modules. The total depth of base 78 plus shim strips 70 is exactly equal to the depth of base 48 of the approach and lane modules.

First wing module 72 is inserted adjacent to approach module 20 and include a first male notch 80 along one side which is designed to extend into the first female notch 56 in approach module 20. Similarly, second wing module 74 includes a first male notch for insertion into female notch 56 which extends along the side of approach module 26. The interlocking action between the male and female notches securely maintains the outer edges of the two wing sections in position with respect to the adjacent approach modules. The outer edges of the bases of the wing modules have been shown having a tapered edge in order to facilitate insertion into the female notches of the adjacent approach modules. The inner edge of each wing module includes a second male notch 84.

The left hand side of key way module 76 includes a first female notch 86 along one side for receiving the second male notch 84 of first wing module 72. The right hand side of key way module 76 includes a second female notch 88 for receiving the second male notch 84 of second wing module 74.

Wing modules 72 and 74 are first inserted adjacent to approach modules 20 and 26. Key way module 76 is positioned last and can be maintained in position by any number of techniques. Key way module 76 can be adhesively bonded to shim strips 70 or coupled by screws to leveling strips 36. Due to the interlock provided between the outer edges of the two wing modules, anchoring key way panel 76 to the lane support structure eliminates any requirement for further securing the wing modules.

Referring now to FIGS. 14 and 15A–D, the method of converting a hardwood plank 90 having a horizontally oriented grain structure into a plurality of hardwood strips having side and bottom surfaces suitable for lamination will now be described. Hardwood maple planks 90 of the type virtually always used in the manufacture of the hardwood deck or panel of bowling alleys is commercially available only as illustrated in FIG. 14, i.e., with a horizontally oriented grain structure. As a result of the great amount of stress and wear imposed upon the hardwood deck of the bowling lane by repeated impact of bowling balls on the lane and by the rolling of the ball along the lane, it is essential that the hardwood panel have a vertically oriented grain structure to provide the maximum available amount of strength and resistance to wear. As a result of periodic refinishing operations required to maintain the bowling lane smooth and level, it also is essential that a vertically oriented grain structure be provided so that the refinishing operation can be accomplished with a minimum amount of erosion and damage to the laminated strips of the panel.

FIG. 15 illustrates that plank 90 is cut into strips by repeatedly passing it through a rip saw at the positions indicated by dotted lines such as line 92. This cutting process yields a strip 94 which has saw cut edges 96 and 98. These two saw cut edges are smooth and readily form a strong bond with other smooth wooden surface such as the smooth surface on the upper side of base 48 of the approach and lane modules.

Since it is absolutely essential that hardwood strip 94 have a vertical grain orientation, the strip illustrated in FIG. 15B must be rotated 90 degrees to the position shown in FIG. 15C. FIG. 15C illustrates in a somewhat exaggerated manner the configuration of vertical edges 100 and 102. When hardwood plank 90 was originally shaped and cut to size at a sawmill, a knife planer was used to cut the plank to a standard depth. As a result of the lateral translation of plank 90 across the rapidly rotating knife bladed cylinder of the knife planer, sides 100 and 102 of the plank are not smooth, but have an irregular or scalloped characteristic. The scalloping of the edges parallel to the grain of the wood of the strips is unsuitable for laminating a plurality of hardwood strips side to side to form the upper hardwood panel of the approach or lane modules. Various types of sanders such as belt sanders and the like are totally unsuited to removing the scalloping from sides 98 and 100 since these devices are unable to maintain the precise strip dimensions required along the complete eight to sixteen foot length of a strip. Any irregularity in dimension created by such a sanding device would render the entire strip useless.

It has been found that a device known as an abrasive planer is able to remove the scalloping from surfaces 100 and 102 of the hardwood strip and to plane the width of strip 94 to the appropriate dimension so that a predetermined number of strips can be joined side to side to form an upper panel of a highly accurate width. Following modification of hardwood strip 94 by an abrasive planer, an adhesive is applied to surfaces 100 and 102 of each strip and the strips are permanently bonded together in an electronic gluing machine which utilizes radio frequency radiation to permanently laminate a group of strips together to form a module. FIG. 15D illustrates the orientation of a plurality of strips immediately prior to the side to side bonding process.

In accordance with the above described procedure, hardwood planks can be bonded together in a side to side manner with a vertical grain orientation to form the hardwood deck of the approach and lane modules and the approach fill means. Each of these structures will be strong and durable and will not suffer delamination as a result of glue line failures induced by defective lamination of strips having scalloped lateral edges.

The system of the present invention has a number of advantages over prior art bowling lane construction techniques. An entire bowling lane can be assembled at the installation site by merely joining five prefabricated approach and lane modules end to end. Each of these modules is readily attached to the existing bowling alley support structure by nailing the hold down strips to the vertically oriented stringers. The gutters are automatically held in place by the notch in the side of the lane modules. The ball guide marks and pin spot marks will have already been installed at the factory. The approach fill means can be readily installed between approach modules and attached to the existing lane support structure. The time required to install a complete replacement bowling lane at the installation site will be reduced approximately by 80 percent in comparison to prior art reconstruction techniques. Futhermore, the size of the crew required to accomplish the installation of the prefabricated bowling lane modules of the present invention is also reduced. As a result, the amount of down time for the bowling alley and the expenses for travel, meals and lodging normally required for a large installation crew is substantially reduced.

Referring now to FIG. 13, occasionally it is necessary only to replace lane module 16 which is sometimes referred to as the ball drop zone and a portion of the approach section. In this case a saw cut is made at points 104 and 106 and a portion of the old approach section and the ball drop zone of the existing lane is removed. Since the wear on the rear portion of the approach section 108 is usually minimal, it can remain in place. A shortened replacement approach module 110 is utilized to fill in the gap between foul line 18 and saw cut 104. The outer ends of modules 110 and 16 can be secured in place by securing means such as vertically disposed screws. Approach fill means of the configuration illustrated in FIG. 6 must be positioned adjacent to each side of shortened approach module 110 to complete the replacement installation. Thus the system of prefabricated bowling lane modules can be used either to replace an entire lane or only the most rapidly worn sections of the approach and ball drop zones.

It will be apparent to those skilled in the art that the disclosed prefabricated bowling lane modules and approach fill means may be modified in numerous ways and may assume many embodiments other than the preferred forms specifically set out and described above. Accordingly, it is intended by the appended claims to cover all such modification of the invention which fall within the true spirit and scope of the invention.

I claim:

1. In a bowling alley having a plurality of lanes, a pair of gutters adjacent each lane, leveling strips positioned below and perpendicular to the lane, and lane support structure positioned below the leveling strips and parallel to the lane, a plurality of prefabricated lane modules which form a complete bowling lane when installed end to each, each lane module comprising:

(a) a base;

(b) a panel formed from a plurality of laminated hardwood strips joined side to side, said panel being bonded to the upper surface of said base and having a width greater than the width of said base to form a female notch along each side of said lane module for securing one side of each adjacent gutter to said lane module; and (c) securing means for attaching said lane module to the lane support structure.

2. The lane module of claim 1 further including coupling means for rigidly coupling an end surface of said lane module to and adjacent end of an adjacent lane module.

3. The lane module of claim 2 wherein said securing means includes a plurality of straps coupled to the base of said lane module and extending downwardly therefrom.

4. The lane module of claim 3 wherein each of said straps has an end inserted into one of a pair of slots in the base of said lane module to securely attach each of said straps to said lane module.

5. The lane module of claim 4 wherein said strap is a metal strap.

6. The lane module of claim 2 wherein said coupling means includes:

(a) a horizontally oriented groove disposed in an end surface of said lane module;

(b) a horizontally oriented groove disposed in an adjacent end surface of an adjacent lane module;

(c) a splice plank inserted within both grooves for vertically aligning said lane module with the adjacent lane module; and (d) means for securing said splice plank to said lane module and to the adjacent lane module to permanently couple the end of said lane module to the end of the adjacent lane module.

7. The lane module of claim 6 wherein said splice plank securing means includes an adhesive applied between said splice plank and the grooves.

8. The lane module of claim 6 wherein said splice plank securing means includes a peg extending vertically from the upper surface to the lower surface of the end portion of said lane module through said splice plank for rigidly coupling said lane module to the adjacent lane module.

9. In a bowling alley having a plurality of lanes, a pair of gutters adjacent each lane, and leveling strips positioned below and perpendicular to the lane and lane support structure positioned below the leveling strips and parallel to the lane, a plurality of prefabricated lane modules which form a complete bowling lane when installed end to end, each lane module comprising:

(a) a base having a slot extending along each lateral side thereof;

(b) a panel formed from a plurality of laminated hardwood strips joined side to side, said panel being bonded to the upper surface of said base and having a width greater than the width of said base to form a female notch along each side of said lane module for securing one side of each adjacent gutter to said lane width;

(c) a plurality of straps each having an end inserted into one or the other of the slots in said base to securely attach each of said straps to said lane module, said straps extending downwardly from the sides of said lane module for rigidly coupling the free ends of said straps to the leveling strips to secure said lane module to the lane support structure; and (d) coupling means for rigidly coupling an end surface of said lane module to an adjacent end of an adjacent lane module.

10. The lane module of claim 9 wherein said coupling means includes:

(a) a horizontally oriented groove disposed in the end surface of said lane module;

(b) a horizontally oriented groove disposed in the end surface of the adjacent lane module;

(c) a splice plank inserted within both grooves for vertically aligning said lane module with the adjacent lane module; and (d) means for securing said splice plank to said lane module and to the adjacent lane module to rigidly couple said lane module to the adjacent lane module.

11. In a bowling alley having a plurality of lanes, an approach area for each lane, lane support structure positioned below and parallel to the lane and approach area and leveling strips positioned above and perpendicular to the support structure, a prefabricated approach module comprising:

(a) a base having a female notch along the lower surface of each side;

(b) a panel formed from a plurality of laminated hardwood strips joined side to side, said panel being bonded to the upper surface of said base and having a width greater than the width of said base to form another female notch along each side of said approach module; and (c) securing means for attaching said approach module to the lane support structure whereby said female notches are designed to be interconnected with matching male notches of approach fill means positioned on each side of said approach module.

12. In a bowling alley having a plurality of lanes, an approach area for each lane, lane support structure positioned below and parallel to the lane and approach areas, and leveling strips positioned above and perpendicular to the support structure, a prefabricated approach section comprising:

(a) a first approach module aligned with a first lane comprising:

i. a base having a second female notch along the lower surface of each side;

ii. a panel formed from a plurality of laminated hardwood strips joined side to side, said panel being bonded to the upper surface of said base and having a width greater than the width of said base to form a first female notch along each side of said first approach module; and iii. securing means for attaching said first approach module to the lane support structure;

(b) a second approach module aligned with a second lane comprising:

i. a base having a second female notch along the lower surface of each side;

ii. a panel formed from a plurality of laminated hardwood strips joined side to side, said panel being bonded to the upper surface of said base and having a width greater than the width of said base to form a first female notch along each side of said second approach module; and iii. securing means for attaching said second approach module to the lane support structure;

(c) approach fill means positionable between said first and second approach modules, supported by and attached to the leveling strips for forming a smooth hard surface area between said first and said second approach modules.

13. The prefabricated approach section according to claim 12 wherein said approach fill means further includes:

(a) a base;

(b) a panel formed from a plurality of laminated hardwood strips joined side to side, said panel being bonded to the upper surface of said base and having a width less than the width of said base to form a first male notch along each side of said approach fill means for receiving the first female notch in the panel of said first and said second approach modules and for permitting the base of said approach fill means to extend into and be locked in place by the first female notches of said first and second approach modules.

14. The prefabricated approach section of claim 13 further including approach fill support means positionable between the base of said approach fill means and the leveling strips for supporting and aligning said approach fill means.

15. The prefabricated approach section of claim 14 wherein said approach fill support means extends into and is locked into position by the second female notches in said first and second approach modules.

16. The prefabricated approach section of claim 15 wherein said approach fill support means includes a shim strip extending under and supporting the base of said approach fill means and extending from the second female notch in one side of said first approach module to the second female notch in one side of said second approach module.

17. The prefabricated approach section of claim 16 wherein said approach fill means includes:

(a) a first wing module adjacent said first approach module having a first male notch along one side for extending into the first female notch in the panel of said first approach module and a second male notch along the opposite side;

(b) a second wing module adjacent said second approach module having a first male notch along one side for extending into the first female notch in the panel of said second approach module and a second male notch along the opposite side; and (c) a key way module having a first female notch along one side for receiving the second male notch of said first wing module and a second female notch on the opposite side for receiving the second male notch of said second wing module;

whereby said first and second wing modules can be positioned adjacent and interlocked with said first and second approach modules after said first and second approach modules have been rigidly mounted.

18. The prefabricated approach section of claim 17 further including securing means for securing said key way module to said first and second wing modules.

19. The prefabricated approach section according to claim 18, wherein said securing means secures said key way module to said approach fill support means.

20. The prefabricated approach section of claim 12 wherein said approach fill means includes:

(a) a first wing module adjacent said first approach module having a first male notch along one side for extending into a first female notch in the panel of said first approach module and a second male notch along the opposite side;

(b) a second wing module adjacent said second approach module having a first male notch along one side for extending into the first female notch in the panel of said second approach module and a second male notch along the opposite side; and (c) a key way module having a first female notch along one side for receiving the second male notch of said first wing module and a second female notch on the opposite side for receiving the second male notch of said second wing module;

whereby said first and second wing modules can be positioned adjacent to and interlocked with said first and second approach modules after said first and second approach modules have been rigidly mounted.

21. The prefabricated approach section of claim 20 further including securing means for securing said key way module to said first and second wing modules.

22. The prefabricated approach section according to claim 21 wherein said securing means secures said key way module to said approach fill support means.

23. A method for prefabricating a lane module in a bowling alley having a plurality of lanes, a pair of gutters adjacent each lane, leveling strips positioned below and perpendicular to the lane, and lane support structure positioned below the leveling strips and parallel to the lane, wherein a plurality of said prefabricated lane modules form a complete bowling lane when installed end to end, said method comprising the steps of:

(a) providing a base;

(b) forming a panel from a plurality of hardwood strips joined side to side and having a width greater than the width of said base;

(c) bonding said panel to the upper surface of said base in an overlapping relationship, thereby forming a female notch along each side of said lane module;

(d) positioning said module such that one side of each adjacent gutter extends into the female notches on each side of said lane module to secure the gutters to said module; and (e) securing said lane module to the lane support structure.

* * * * *